United States Patent [19]

Smith

[11] Patent Number: 5,014,734

[45] Date of Patent: May 14, 1991

[54] QUICK DROP VALVE

[75] Inventor: David P. Smith, Joliet, Ill.

[73] Assignee: Caterpillar Inc., Peoria, Ill.

[21] Appl. No.: 576,033

[22] Filed: Aug. 31, 1990

[51] Int. Cl.[5] ..... F15B 11/08

[52] U.S. Cl. ..... 137/117; 91/436; 91/442

[58] Field of Search ..... 137/87, 117; 91/462, 91/464, 436

[56] References Cited

U.S. PATENT DOCUMENTS

| | | | |
|---|---|---|---|
| 3,335,739 | 8/1967 | Rice | 91/436 X |
| 3,448,685 | 8/1967 | Kroth | 91/436 |
| 3,568,707 | 3/1971 | Shore | 137/117 |
| 3,786,827 | 1/1974 | Berg | 91/436 X |
| 3,795,177 | 3/1974 | Cryder et al. | 91/411 |
| 4,397,221 | 8/1983 | Friesen | 91/436 X |
| 4,510,963 | 4/1985 | Presley | 137/117 |

*Primary Examiner*—Alan Cohan
*Attorney, Agent, or Firm*—John W. Grant

[57] ABSTRACT

Quick drop valves are usable in hydraulic circuits in which fluid is expelled from a hydraulic cylinder due to gravity force acting on a load connected to the hydraulic cylinder. The present quick drop valve has a sleeve carried by a valve member for establishing an orifice through which the fluid expelled from the hydraulic cylinder passes. When the flow rate of the expelled fluid exceeds a predetermined flow rate, a differential pressure generated by the orifice causes the valve member to start moving toward a quick drop position. In so doing, the sleeve quickly establishes a more restrictive orifice to immediately generate a higher differential pressure to cause the valve member to quickly move to the quick drop position. The more restrictive orifice also causes a greater amount of the expelled fluid to be returned by the valve member to the expanding ends of the hydraulic cylinders, yet still allows sufficient flow therethrough so that the quick drop action can be stopped if so desired. The sleeve also functions similar to a check valve and moves to a position permitting substantially unrestricted fluid flow through the quick drop valve when the fluid is being directed to the hydraulic cylinder to raise the load. An actuating chamber is defined in the valve member and is subjected to pressurized fluid generated in the circuit to hold the valve member in a blocking position when the blade is forced into the ground.

8 Claims, 2 Drawing Sheets

QUICK DROP VALVE

TECHNICAL FIELD

This invention relates generally to a hydraulic circuit for controlling the elevational position of a bulldozer blade or the like and more particularly, to a quick drop valve for improving the efficiency of the circuit.

BACKGROUND ART

Quick drop valves are commonly used in hydraulic control circuits for bulldozer blades or the like in which the blade is allowed to free-fall to ground level under the force of gravity. Some of the fluid expelled from the hydraulic cylinders which control blade elevation is diverted by the quick drop valves to the expanding ends of the hydraulic cylinders to supplement the pump flow thereto. Without any type of quick drop valve, the expanding ends of the hydraulic cylinders cavitate quite badly. Since the cavitated ends of the cylinders have to be filled with fluid from the pump after the blade comes to rest on the ground a considerable time lag occurs before sufficient downward force can be applied to the blade for penetrating the ground. The use of quick drop valves minimizes the cavitation and thus reduces the time lag.

The duration of the time lag depends upon the efficiency of the quick drop valve which is determined by the amount of expelled fluid that the quick drop valve diverts back to the expanding side of the cylinders. That amount is dependent upon how quickly the quick drop valve moves to the quick drop position in a free-fall situation and the percentage of the expelled fluid that the quick drop valve diverts back to the expanding ends once it is in the quick drop position.

The known quick drop valves are moved to and retained in the quick drop position by differential pressure generated by the expelled fluid passing through a fixed triggering orifice once the flow rate of the expelled fluid exceeds a predetermined rate. The size of the fixed orifice usually dictates both how quickly sufficient differential pressure is generated to move the valve to the quick drop position and how much of the expelled fluid can be diverted to the expanding ends of the hydraulic cylinders. One of the problems encountered with the use of the fixed orifice is that the fluid being directed to the hydraulic cylinders to raise the blade also passes through that orifice. If the size of the orifice is reduced to a size for maximum efficiency in the quick drop mode, it restricts the flow from the pump to the hydraulic cylinders in the raise mode thereby limiting the speed at which the blade can be raised. Thus, the size of the triggering orifice is normally dictated by the rate of fluid flow from the pump to the cylinder in the raise mode such that maximum efficiency of the quick drop valve cannot be realized.

Heretofor the efficiency of the quick drop valves have been such that if a single quick drop valve was used to handle the flow from two or more hydraulic cylinders, the duration of the time lag to fill the cylinders at the ground level increased. If a quick drop valve was used for each cylinder, the overall cost of the control circuit increased. A larger single quick drop valve of the current design could possibly handle the combined flow of two or more cylinders but would increase the cost of the valve, the time lag, and implement drift.

It would be desirable to have a quick drop valve constructed so that its efficiency is such that a single quick drop valve could handle the fluid flow from two or more hydraulic cylinders without increasing the duration of the time lag or restrict fluid flow to the cylinders in the raise mode and which can be built for considerably less than the cost of the separate currently available quick drop valves required to handle the same flow. In one mode of operation, the blade is allowed to free fall from the raised position and then suddenly stopped before the blade reaches the ground to shake loose any material that might be adhering to the blade. Thus, it is desirable for the quick drop valve to be capable of being shifted from the quick drop position to the non-quick drop position at any point in the free-fall to provide this function.

The present invention is directed to overcoming one or more of the problems as set forth above.

DISCLOSURE OF THE INVENTION

In one aspect of the present invention a quick drop valve comprises a housing having a bore and first, second and third annuluses communicating with, and axially spaced along, the bore. A valve member is slidably disposed in the bore and defines an actuating chamber between the valve member and the housing. The valve member is moveable between a first position at which the first annulus is blocked from the second annulus and a second position at which the second annulus communicates with the first annulus. A means is provided for biasing the valve to the first position. Another means is provided for continuously communicating the second annulus with the actuating chamber. A valve means defines a first orifice between the second and third annuluses when the valve member is at the first position and a second more restrictive orifice between the second and third annuluses when the valve member is at the second position. The valve means also provides substantially unrestricted fluid flow from the third annulus to the second annulus at the first position of the valve member.

BEST MODE FOR CARRYING OUT THE INVENTION

Figure 1:
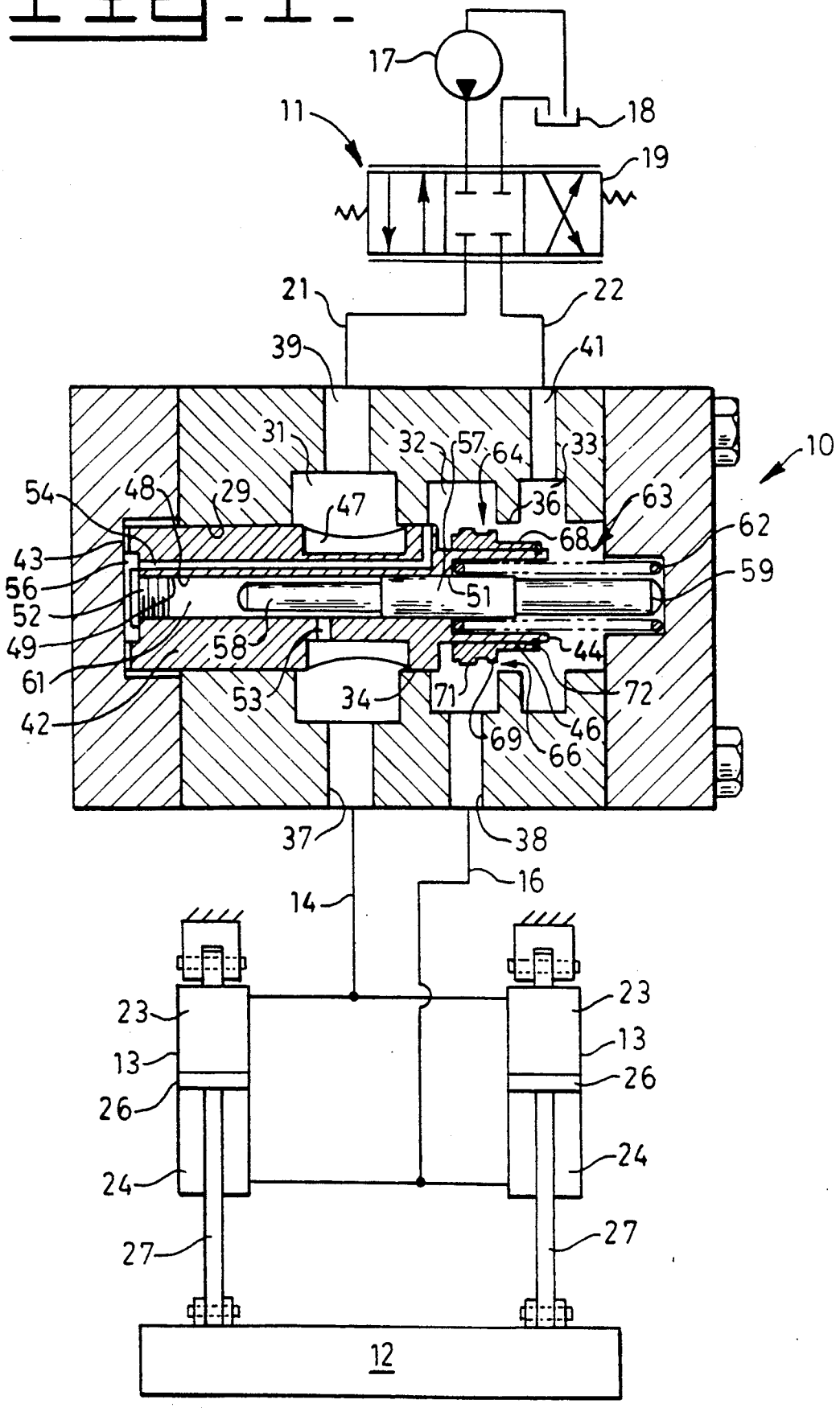
FIG. 1 is a diagrammatic sectional view of an embodiment of the present invention incorporated within a hydraulic control circuit.

A quick drop valve 10 is shown incorporated within a hydraulic circuit 11 for controlling the elevation of a load which in this embodiment is represented by a bulldozer blade 12. The hydraulic circuit 11 includes a pair of double acting hydraulic cylinders 13, a pair of cylinder conduits 14,16 connecting the quick drop valve 10 to opposite ends of the hydraulic cylinders, a pump 17 and a tank 18 connected to a directional control valve 19, and a pair of valve conduits 21,22 connecting the directional control valve 19 to the quick drop valve. The hydraulic cylinders 13 are suitably connected to a work vehicle, not shown, in the usual manner with each cylinder having a head end 23 connected to the cylinder conduit 14, a rod end 24 connected to the cylinder conduit 16, a piston 26 slidably disposed therein, and a piston rod 27 connecting the pistons 26 to the blade 12. The blade is acted on by gravity such that the weight thereof establishes a generally downwardly dropping direction tending to extend the hydraulic cylinders.

The quick drop valve 10 includes a multi-piece housing 28 having a bore 29 therein and a plurality of annuluses 31,32,33 in open communication with, and axially spaced along the bore 29. The adjacent annuluses 31 and 32 are separated by a control land 34 and the adjacent annuluses 32 and 33 are separated by another control land 36. The housing also has a pair of cylinder ports 37,38 communicating with the annuluses 31 and 32 respectively and a pair of valve ports 39,41 communicating with the annuluses 31 and 33 respectively. The cylinder conduits 14 and 16 are connected to the cylinder ports 37 and 38 respectively and the valve conduits 21 and 22 are connected to the valve ports 39 and 41 respectively. Alternatively, the valve port 39 may be omitted and the valve conduit 21 connected directly to the cylinder conduit 14. Another alternative would be to mount the housing 28 directly to one of the cylinders 13 with the porting therein suitably changed.

Figure 2:
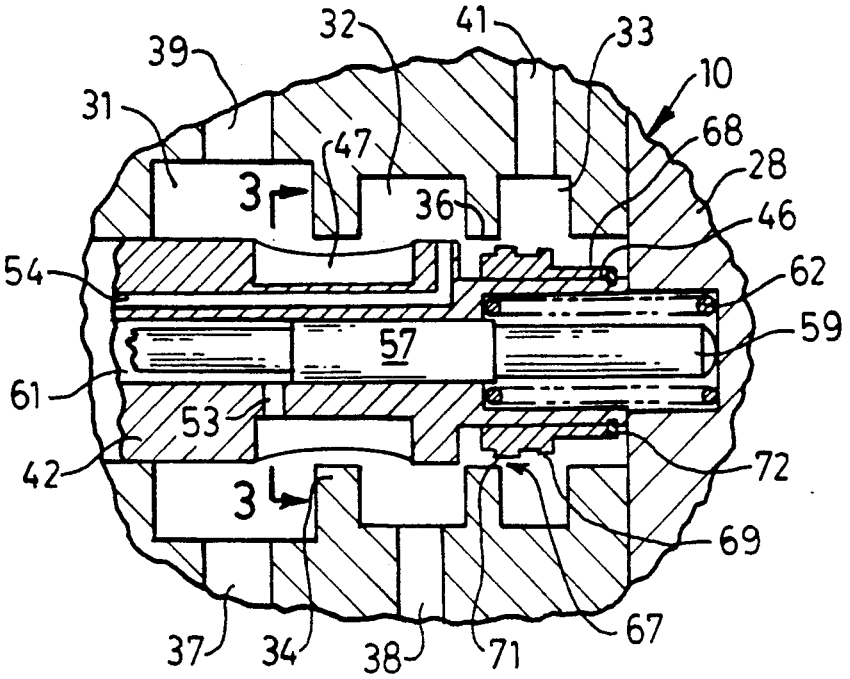
FIG. 2 is a somewhat enlarged sectional view of a portion of FIG. 1 showing another position of the components.
Figure 3:
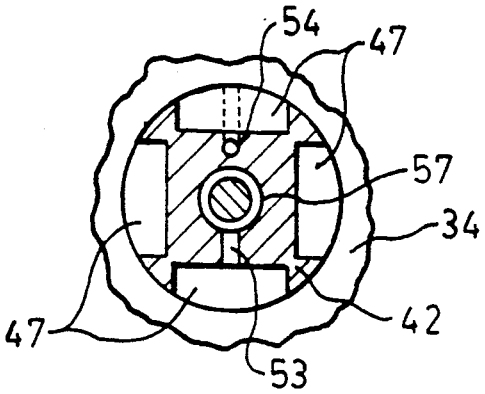
FIG. 3 is a sectional view taken along line 3—3 of FIG. 2.

A cylindrical valve member 42 is slidably disposed in the bore 29 and has opposite ends 43,44 and a reduced diameter portion 46 adjacent the end 44. A plurality of concentrically spaced fluid control pockets 47 are provided in the valve member 42 intermediate its ends. An axially extending stepped bore 48 is formed in the valve member and has opposite ends 49,51. The end 49 is sealingly closed with a threaded plug 52 and will hereinafter be referred to as the closed end while the end 51 will be referred to as the open end. A radial passage 53 connects one of the pockets 47 with the bore 48. The valve member 42 has a passageway 54 which continuously communicates the annulus 32 with an actuating chamber 56 at the end 43 of the valve member. The valve member 42 is shown in FIG. 1 at a blocking or first position in which the annulus 31 is blocked from communication with the annulus 32 and is moveable rightwardly to a quick drop or second position, as shown in FIG. 2, at which the annulus 32 is in communication with the annulus 31 through the fluid control pockets 47.

An elongate bias piston 57 is slidably disposed in the bore 48 of the valve member 42 and has opposite reduced diameter end portions 58,59. The end portion 59 projects outwardly of the open end 51 and is normally in contact with the housing 28. The end portion 58 defines an actuating chamber 61 at the closed end 49 of the bore 48. The radial passage 53 is in continuous communication with the actuating chamber 61.

A coil compression spring 62 circumscribes the portion of the piston 57 extending beyond the valve member 42 and is disposed between the valve member 42 and the housing 28 for resiliently biasing the valve member to the first position. The spring 62 and the force exerted on the valve member by the pressurized fluid in the actuating chamber 61 provides a means 63 for biasing the valve member to the first position.

A valve means 64 is provided for defining a first annular orifice 66 between the annuluses 32,33 when the valve member 42 is at the first position, for defining a second, more restrictive annular orifice 67 between the annuluses 32,33 when the valve member is at the second position and for providing substantially unrestricted fluid flow from the annulus 33 to the annulus 32 when the valve member is at the first position.

The valve means 64 includes a cylindrical sleeve 68 having a pair of axially spaced cylindrical lands 69,71 with the land 71 being cylindrically larger than the land 69. The sleeve 68 is slidably disposed on the reduced diameter portion 46 of the valve member 42 and is retained thereon by a retaining ring 72. With the valve member and the sleeve at the position shown in FIG. 1, the annular land 69 cooperates with the land 36 of the housing 28 to define the orifice 66. When the valve member is at the second position shown in FIG. 2, the annular land 71 cooperates with the land 36 to define the orifice 67. The sleeve is moveable leftwardly relative to the valve member to a position at which the land 69 is spaced from the land 36 to provide the substantially unrestricted fluid flow from the annulus 33 to the annulus 32 when the valve member is at the first position. Alternatively, the sleeve can be designed to replace the annular lands 69 and 71 with, for example, a conical or other shaped surface to provide a variable orifice wherein the orifice 67 would be the most restrictive portion thereof while the orifice 66 would be the least restrictive portion thereof.

Industrial Applicability

The valve member 42 of the quick drop valve 10 is normally held in the first position by the spring 62 when the control valve 19 is at the neutral position shown. To raise the blade 12, the operator moves the control valve 19 leftwardly to connect the pump 17 to the conduit 22 and the conduit 21 to the tank 18. The pressurized fluid from the pump passes through the control valve 19, the conduit 22 and into the annulus 33. The sleeve 68 functions similar to a check valve such that the fluid passing from the annulus 33 to the annulus 32 moves the sleeve 68 leftwardly to provide substantially unrestricted fluid flow therebetween. The pressurized fluid in the annulus 32 passes through the port 38, the conduit 16 and into the rod ends 24 of both cylinders 13 causing the pistons 26 to retract thereby raising the blade. The fluid expelled from the head ends 23 passes through the conduit 14, the port 37, the annulus 31, the port 39, the conduit 21, and the control valve 19 to the tank 18.

To controllably lower the blade 12, the operator moves the control valve 19 rightwardly only part way from the neutral position shown to communicate the pump 17 with the conduit 21. The pressurized fluid from the pump passes through the control valve 19, the conduit 21, the port 39, the annulus 31, the port 37, the conduit 14 and into the head ends 23. The fluid expelled from the rod ends 24 passes through the conduit 16, the port 38, the annulus 32, the annulus 33, the port 41, the conduit 22, and the control valve 19 to the tank 18. The flow forces acting on the sleeve 68 biases it to the position shown in FIGS. 1 and 2 to establish the orifice 66. Alternatively, a lightweight coil spring can be used to resiliently bias the sleeve to the position shown in FIGS. 1 and 2. With the control valve 19 in a partial actuated condition, it restricts the fluid being expelled from the rod ends to a flow rate less than a predetermined flow rate. When the fluid flow rate of fluid passing through the orifice 66 is less than the predetermined flow rate, the differential pressure generated by the orifice 66 is below a predetermined magnitude. Thus, the pressure in the annulus 32 and passing through the passageway 54 to the actuating chamber 56 is insufficient to move the valve member 42 rightwardly against the spring 62 to the quick drop position.

To allow the blade to free-fall from the raised position, the operator moves the control valve 19 rightwardly to or beyond a trigger point at which the control valve 19 offers little restriction of the fluid being expelled from the rod ends 24 of the cylinders. Under such condition, the fluid flow passing through the orifice 66 exceeds the predetermined flow rate, thereby generating a differential pressure sufficient to move the valve member 42 rightwardly to the quick drop position. More specifically, when the differential pressure exceeds the predetermined magnitude, the higher pressure in the annulus 32 is directed through the passageway 54 into the actuating chamber 56. With the differential pressure exceeding the predetermined magnitude the fluid generated force acting on the end 43 is greater than the fluid generated force acting on the opposite end 44 of the valve member by an amount greater than the force of the spring 62. Thus, the valve member 42 is moved rightwardly toward the second position. As the valve member 42 moves rightwardly, the annular land 71 creates the more restrictive orifice 67 causing a much greater differential pressure, thereby causing the valve member to move more rapidly to the fully actuated second position. With the valve member at the second position, the annulus 32 communicates with the annulus 31 through the pockets 47 thereby allowing the fluid expelled from the rod ends to pass therethrough and combines with the fluid from the pump with the combined flow passing through the port 37 and the conduit 14 to fill the expanding ends of the hydraulic cylinders. The more restricted orifice 67 functions also to limit fluid flow therethrough so that a greater amount of fluid expelled from the rod ends is used to fill the expanding head ends 23 of the cylinders. The amount of fluid passing through the orifice 67 is selected to maintain a differential pressure sufficient to keep the valve member 42 in the quick drop position. The fluid passing through the orifice 67 passes through the control valve 19 to the tank 18. Thus the operator can stop the blade at any position during the free-fall by moving the control valve 19 toward the centered position past the trigger point. This increases the restriction to fluid flow through the control valve 19 sufficiently to reduce the fluid flow across the orifices 67 and 66 which in turn reduces the differential pressure to a magnitude such that the spring 62 moves the valve member to the first position.

When the the blade 12 contacts the ground, the valve member 42 of the quick drop valve 10 immediately shifts back to the non quick drop or first position automatically without any additional effort required by the operator so that down pressure is quickly applied to the blade for penetrating the ground. More specifically, when the blade contacts the ground, and extension of the hydraulic cylinders 13 stops, fluid is no longer expelled from the rod ends 24 of the cylinders. With no fluid passing through the orifices 67 or 66, the pressure differential reduces allowing the spring 62 to move the valve member 42 to the first position. Pressure can then build up in the fluid flow path between the pump and the head ends of the hydraulic cylinders. The fluid pressure in the annulus 31 passes through the radial passage 53 into the actuating chamber 61. With the reduced diameter end portion 59 of the piston 57 being in contact with the housing 28, the pressurized fluid in the actuating chamber 61 increases the leftward bias on the valve member 42 causing it to move to the first position. In such position the conduits 14,16 are isolated from one another so that full pump pressure can be generated in the head ends 23 of the hydraulic cylinder 13 to exert downward force on the blade 12 even if the control valve 19 is shifted beyond the trigger point.

In view of the foregoing it is readily apparent that the structure of the present invention provides an improved quick drop valve having a valve means which provides two distinct orifices in one direction of fluid flow therethrough and which functions similar to a check valve and moves to a position for substantially unrestricted fluid flow therethrough in the opposite direction. Thus, one of the orifices can be sized for permitting normal operation of the hydraulic circuit while quickly generating a differential pressure to start shifting the valve member toward the second position when the fluid flow rate exceeds a predetermined flow rate with the other orifice substantially restricting fluid flow therethrough so that a greater amount of the expelled fluid can be used for filling the expanding ends of the hydraulic cylinders. Since the valve means functions similar to a check valve, the size of the orifices have no effect on the fluid flow in the opposite direction so that the orifices can be sized to achieve maximum efficiency of the quick drop valve in its first position. An additional bias piston maintains the valve member in the first position, when the blade is on the ground and a downward force is being exerted by the hydraulic cylinders. A quick drop valve constructed in accordance with the embodiment shown in the drawings has achieved an efficiency such that a single quick drop valve can handle the fluid flow from two hydraulic cylinders, yet still reduces the duration of the time lag while maintaining the same quick drop time.

Other aspects, objects and advantages of this invention can be obtained from a study of the drawings, the disclosure and the appended claims.

I claim:

1. A quick drop valve comprising:

a housing having a bore and first, second and third annuluses communicating with and axially spaced along the bore;

a valve member slidably disposed in the bore and defining an actuating chamber between the valve member and the housing, the valve member being moveable between a first position at which the first annulus is blocked from the second annulus and a second position at which the second annulus communicates with the first annulus;

means for biasing the valve member to the first position;

means for continuously communicating the second annulus with the actuating chamber; and valve means for defining a first orifice between the second and third annuluses when the valve member is at the first position, for defining a second, more restrictive orifice between the second and third annuluses when the valve member is at the second position and for providing substantially unrestricted fluid flow from the third annulus to the second annulus at the first position of the valve member.

2. The quick drop valve of claim 1 wherein the valve means is carried by the valve member.

3. The quick drop valve of claim 2 wherein the valve means includes a sleeve having first and second axially spaced cylindrical lands with the second land being cylindrically larger than the first land, said sleeve being slidably disposed on the valve member and moveable between a first position at which the first land cooperates with the housing to define the first orifice and the second land defines the second orifice, and a second position at which the lands are spaced from the housing to provide said unrestricted fluid flow from the third annulus to the second annulus.

4. The quick drop valve of claim 3 wherein said valve member has a reduced diameter portion with the sleeve being slidably disposed on the reduced diameter portion.

5. The quick drop valve of claim 4 wherein the continuously communicating means includes a passageway in the valve member.

6. The quick drop valve of claim 3 wherein the valve member includes a plurality of circumferentially spaced fluid control pockets in continuous communication with the first annulus and which are blocked from the second annulus at the first position of the valve member and which communicate the second annulus with the first annulus at the second position of the valve member.

7. The quick drop valve of claim 3 wherein the biasing means includes a spring resiliently biasing the valve member toward the first position.

8. The quick drop valve of claim 3 including a bore in the valve member and having a closed end and an open end, a piston slidably disposed in the bore forming an actuating chamber in the valve member at the closed end of the bore, the piston extending beyond the open end of the bore into engagement with the housing, and a radial passage in the valve member communicating the first annulus with the actuating chamber in the valve member.

* * * * *